US005560990A

United States Patent [19]

Ilg et al.

[11] Patent Number: 5,560,990

[45] Date of Patent: Oct. 1, 1996

[54] FIBER BLEND

[75] Inventors: Otto Ilg; Dominick A. Burlone, both of Asheville, N.C.; William Theuer, Lake Wylie, S.C.; Heinz Berbner, Mörlenbach, Germany; Gernot Herbst, Wachenheim, Germany; Karl Ott, Plankstadt, Germany; Hans D. Zettler, Grünstadt, Germany

[73] Assignee: BASF Aktiengesellschaft, Ludwigshafen, Germany

[21] Appl. No.: 433,508

[22] PCT Filed: Nov. 4, 1994

[86] PCT No.: PCT/EP94/03628

§ 371 Date: May 12, 1995

§ 102(e) Date: May 12, 1995

[87] PCT Pub. No.: WO95/14126

PCT Pub. Date: May 26, 1995

[30] Foreign Application Priority Data

Nov. 15, 1993 [DE] Germany ..... 43 38 942.2

[51] Int. Cl.[6] ..... D02G 3/00

[52] U.S. Cl. ..... 428/362; 428/373; 525/428

[58] Field of Search ..... 428/370, 362, 428/373, 288; 525/428

[56] References Cited

U.S. PATENT DOCUMENTS

| | | | |
|---|---|---|---|
| 3,664,905 | 5/1972 | Schuster | 161/59 |
| 4,088,620 | 5/1978 | Nihongi et al. | 260/29.4 |
| 4,112,016 | 9/1978 | Moulds | 525/428 |
| 4,291,087 | 9/1981 | Warburton, Jr. | 428/375 |
| 4,497,934 | 2/1985 | Streetman | 528/428 |
| 4,557,969 | 12/1985 | Berbner et al. | 428/288 |
| 5,206,066 | 4/1993 | Horacek | 428/224 |
| 5,322,915 | 6/1994 | Weiser et al. | 528/163 |

FOREIGN PATENT DOCUMENTS

| | | |
|---|---|---|
| 221330 | 5/1987 | European Pat. Off. . |
| 533931 | 3/1993 | European Pat. Off. . |

*Primary Examiner*—Newton Edwards
*Attorney, Agent, or Firm*—Keil & Weinkauf

[57] ABSTRACT

The disclosure is directed to fiber blends of melamine resin fibers and aramid fibers.

10 Claims, No Drawings

FIBER BLEND

BACKGROUND OF THE INVENTION

Field of the Invention

The present invention relates to a blend of melamine resin fibers and aramid fibers.

Fibers comprising melamine-formaldehyde condensation products are known, for example from DE-B-2 364 091. They are nonflammable, flame resistant and heat resistant. Owing to these properties, they are used for manufacturing fire resistant textiles. However, there are applications for which the fibers are not sufficiently strong or abrasion resistant.

Fibers comprising polycondensation products of isophthalic or terephthalic acid and phenylenediamine have likewise been known for a long time. They too have a favorable behavior in a fire environment. However, on processing into yarn by the worker-and-stripper carding process the low processing speed of the aramid staple fibers is disadvantageous.

SUMMARY OF THE INVENTION

It is an object of the present invention to improve the properties of melamine resin fibers on the one hand and the properties of aramid fibers on the other.

We have found that this object is achieved by blends of the two fibers.

DESCRIPTION OF THE PREFERRED EMBODIMENTS

According to DE-B-2 364 091, the melamine resin solution used for spinning the melamine resin fibers may have added to it solutions of other fiber-forming polymers, including solutions of polyamides in organic solvents. Preference is given to adding to the melamine resin solution aqueous solutions of polyvinyl alcohol as a way of improving the mechanical properties of the fibers produced by the spinning process. This reference thus involves spinning mixtures or solutions of different polymers to produce blended, multicomponent fibers, whereas the present invention involves blending different ready-produced fibers to thereby produce fiber blends.

A. Melamine resin fibers are notable for their high temperature resistance and nonflammability. Their preparation and properties are known, for example from DE-A-2 364 091. They are preferably produced from highly concentrated solutions of melamine-formaldehyde precondensation products, after addition of an acidic curing agent, by rotospinning, drawing out, extrusion or fibrillation. The fibers obtained are generally predried with or without stretching, and the melamine resin is usually cured at from 120° to 250° C. The fibers are usually from 5 to 25 μm in thickness and from 2 to 2000 mm in length. Particularly thermally stable fibers are obtained when up to 30 mol %, in particular from 2 to 20 mol %, of the melamine in the melamine resin is replaced by a hydroxyalkylmelamine, as described in EP-A-221 330 or EP-A-523 485. Such fibers have a sustained use temperature of up to 200° C., preferably up to 220° C. In addition, minor amounts of melamine can be replaced by substituted melamines, urea or phenol. Particular preference is given to condensation products obtainable by condensation of a mixture containing as essential components (A) from 90 to 99.9 mol % of a mixture consisting essentially of (a) from 30 to 99 mol % of melamine, and (b) from 1 to 70 mol % of a substituted melamine of the general formula I

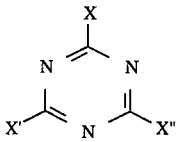

I where X, X' and X" are each selected from the group consisting of —$NH_2$, —NHR and —NRR', and X, X' and X" are not all —$NH_2$, and R and R' are each selected from the group consisting of hydroxy-$C_2$-$C_{10}$-alkyl, hydroxy-$C_2$-$C_4$-alkyl-(oxa-$C_2$-$C_4$-alkyl)$_n$, where n is from 1 to 5, and amino-$C_2$-$C_{12}$-alkyl, or mixtures of melamines I, and (B) from 0.1 to 10 mol %, based on (A) and (B), of phenols which are unsubstituted or substituted by radicals selected from the group consisting of $C_1$-$C_9$-alkyl and hydroxyl, $C_1$-$C_4$-alkanes substituted by two or three phenol groups, di (hydroxyphenyl) sulfones, or mixtures of these phenols, with formaldehyde or formaldehyde source compounds in a molar ratio of melamine to formaldehyde within the range from 1:1.15 to 1:4.5.

B. Aramid fibers are notable for their favorable behavior in a fire environment. They are preferably produced by spinning solutions of polycondensation products of isophthalic or terephthalic acid with para- or meta-phenylenediamine in solvents, for example a mixture of N-vinylpyrrolidone and hexamethylphosphoramide. The resulting continuous fibers are then cut into staple fibers, whose thickness is usually from 5 to 25 μm. Preferred aramid fibers are those based on an isomeric poly-(p-phenyleneterephthalamide).

Both fibers may contain the customary additives such as fillers, dyes, pigments, metal powders and delusterants. The two fibers are as a rule intermixed on conventional fiber-blending apparatus as described in Vliesstoffe, Georg Thieme Verlag. The starting materials are usually staple fibers of a usual length from 1 to 20 cm. These are usually fed via a conveying means into a flat card and premixed therein. The intermixing is then generally completed in a worker-and-stripper card. The wadding obtained is then as a rule further processed into yarns or webs, for which the processes customary in the textile industry can be used.

These yarns, webs or fabrics can then be further processed into various textile or non-textile structures, depending on the field of application.

Blends containing minor amounts of aramid fibers, for example from 5 to 30% by weight, can be processed as yarn into fabrics, for example for nonflammable drapes or airplane textiles, having very good properties, for example a low smoke density. Compared with fabrics made of melamine resin fibers alone, they exhibit enhanced strength.

Furthermore, such yarns which consist predominantly of melamine resin fibers and may additionally contain glass or polyacrylonitrile fibers in admixture can be used for manufacturing friction linings, for example for clutches.

To produce webs from the fiber blend of the invention, preferably with an aramid fiber content from 20 to 70% by weight, the wadding obtained in the worker-and-stripper carding process is usually needled. The web obtained can be used for example for producing filter inserts, in which case the filtration performance is distinctly improved compared with webs made with aramid fibers alone. Similarly, the web can be used for manufacturing fire blockers for seats in means of transport and items of furniture. Furthermore, the web can be used for producing thermally and acoustically insulating fiber mats as described in EP-B-80 655. Such mats possess enhanced strength.

Fiber blends which consist predominantly of aramid fibers and have for example an aramid fiber content of from 95 to 60, preferably from 95 to 80, % by weight are surprisingly spinnable at a higher rate of speed in the worker-and-stripper carding process in the course of yarn making than pure aramid fibers. Such yarns can be used to produce fabrics and webs which can be used for example for fire resistant suits and for heat blockers.

Finally, the fiber blends can be admixed with binding fibers to produce moldings. The binding fibers can consist of condensation resins or thermoplastics.

We claim:

1. A fiber blend consisting essentially of

A. 5–95 parts by weight of melamine resin fibers, and

B. 95–5 parts by weight of aramid fibers.

2. A process for producing a fiber blend as defined in claim 1 by blending finished fibers, wherein the blend consists essentially of A. 5–95 parts by weight of melamine resin fibers, and B. 95–5 parts by weight of aramid fibers.

3. A fiber blend as defined in claim 1, wherein the melamine resin fibers comprise a melamine-formaldehyde condensation product in which from 2 to 20 mol % of the melamine is replaced by a hydroxyalkylmelamine.

4. A fiber blend as defined in claim 1, wherein the aramid fibers comprise a polycondensation product of isophthalic or terephthalic acid with a meta- or para-phenylenediamine.

5. A fiber blend as defined in claim 1, wherein the aramid fibers comprise an isomeric poly(p-phenyleneterephthalamide).

6. Yarns produced from the fiber blend of claim 1.

7. Tapes and moldings produced from the fiber blend of claim 1.

8. Fabrics produced from the fiber blend of claim 1.

9. Webs produced from the fiber blend of claim 1.

10. Friction linings produced from the fiber blend of claim 1.

* * * * *